US006094928A

United States Patent [19]

Oyabu et al.

[11] Patent Number: 6,094,928

[45] Date of Patent: Aug. 1, 2000

[54] OUTDOOR UNIT OF SEPARATE TYPE AIR CONDITIONER

[75] Inventors: Keiko Oyabu, Yasu-gun; Mitsuo Nakanuma, Gamou-gun; Koji Hatano, Otsu, all of Japan

[73] Assignee: Matsushita Electric Industrial Co., Ltd., Osaka, Japan

[21] Appl. No.: 09/180,592

[22] PCT Filed: Feb. 20, 1998

[86] PCT No.: PCT/JP98/00723

§ 371 Date: Nov. 10, 1998

§ 102(e) Date: Nov. 10, 1998

[87] PCT Pub. No.: WO98/40676

PCT Pub. Date: Sep. 17, 1998

[30] Foreign Application Priority Data

Mar. 10, 1997 [JP] Japan ..... 9-054866

[51] Int. Cl.[7] ..... F25D 23/12

[52] U.S. Cl. ..... 62/259.1; 62/272; 62/298

[58] Field of Search ..... 62/259.1, 272, 62/298, 285

[56] References Cited

U.S. PATENT DOCUMENTS 4,736,598 4/1988 Sameshima et al. ..... 62/259.1
5,711,162 1/1998 Wolanin et al. ..... 62/302
5,775,119 7/1998 Yamada et al. ..... 62/259.1

FOREIGN PATENT DOCUMENTS 58-196765 12/1983 Japan .
1-78833 5/1989 Japan .
5-187670 7/1993 Japan .

OTHER PUBLICATIONS

English translation of Form PCT/ISA/210.

*Primary Examiner*—Henry Bennett
*Assistant Examiner*—Melvin Jones
*Attorney, Agent, or Firm*—Ratner & Prestia

[57] ABSTRACT

An outdoor unit of a separate type air-conditioner, of which work efficiency of piping and maintenance accessed from the top is improved, is provided. At the same time, water is prevented from invading onto compressor-related electrical parts. An upper section of a housing is disclosed by removing a top plate of the housing, whereby a compressor room is disclosed. The compressor room is divided by a valve mounting plate into a lower chamber A containing a compressor together with nearby placed compressor-related electrical parts and an upper chamber B containing connecting valves that connect the compressor to a coolant pipe from an indoor unit. In the outdoor unit where the connecting valves are mounted on the valve mounting plate, an opening for work is provided on the valve mounting plate so that the compressor-related electrical parts are operated through this opening from the top. A surrounding wall rising upward is disposed on an edge of the opening.

2 Claims, 3 Drawing Sheets

OUTDOOR UNIT OF SEPARATE TYPE AIR CONDITIONER

This application is a U.S. National Phase application of PCT International application PCT/JP98/00723.

TECHNICAL FIELD

The present invention relates to outdoor units of separate type air-conditioners, more particularly to the outdoor unit to which piping and maintenance works are provided from the above thereof.

PRIOR ART

An outdoor unit of the separate type air-conditioner has been mounted, in general, to a wall just under a window, veranda, stairs or rooftop even these places are at rather high locations of a building. The outdoor units mounted such high places are desirably given piping and maintenance works from the above thereof among others. A conventional outdoor unit, as shown in FIGS. 5(*a*) and 5(*b*), is designed as follows in order to meet this requirement: the outdoor unit is mounted to a wall using a mounting section 26, and both the connecting section and the wiring section of pipes are provided at the upper portion of a housing 21 so that these sections can be accessed from outside the housing to provide various works by just removing a top plate 22 of the housing 21.

Connecting valves 23 are supported by a valve mounting plate 25, which covers substantially entire upper section of a compressor room, prevents dewing produced on the connecting valves 23 due to operation from dropping to compressor-related electrical parts 24 disposed in a lower chamber D. This valve mounting plate 25 guides water from the valves 23 to drop to the places other than the components of electrical equipment or the like that should be avoided to being watered.

The conventional outdoor unit, however, does not disclose the lower chamber D, where the compressor-related electrical parts 24 are mounted, even the top plate 22 is removed. The valve mounting plate 25 must be further removed to expose the lower chamber D. The maintenance work for the parts 24 is thus not readily provided. When the plate 25 is removed, large outside pipes connected to the plate 25 via connecting valve 23 must be removed from the valve 23 firstly, which makes the removal of the valve mounting plate 25 not so easy. The consideration for the top accessible work of maintenance, which practically saves a dismounting of the entire outdoor unit from the wall, does not actually give full advantages to the conventional outdoor unit.

The valve mounting plate 25 is disposed horizontally, therefore, dew water does not drain before the water height reaches to a draining section. A little water stays and contacts to the plate 25 for a long time, thereby to rust the plate.

The present invention addresses these problems, and aims to provide an outdoor unit for the separate type air-conditioner by improving work efficiencies of piping and maintenance from the top as well as preventing water from invading into the compressor-related electrical parts.

DISCLOSURE OF THE INVENTION

The present invention embodies the following ideas in order to realize the above objects: (1) The compressor room is partitioned by a valve mounting plate into a lower chamber and an upper chamber; the lower chamber contains a compressor and compressor-related electrical parts, the upper chamber contains connecting valves that connect coolant valves from an indoor unit to the compressor. (2) On the valve mounting plate, an opening for work is provided so that the above parts can be operated through this opening from the top. (3) The opening is bordered with a surrounding wall rising vertically from the edge of the opening.

According to the outdoor unit for the separate type air-conditioner of the present invention which embodies the above ideas, the following advantages are produced: (a) since the upper chamber is disclosed upward by removing the top plate, the connecting valves supported by the valve mounting plate can be connected or disconnected with ease to/from the coolant pipe from the indoor machine, (b) the compressor-related electrical parts can be readily adjusted and maintained when necessary, (c) the surrounding wall rising vertically on the edge of the opening prevents dew water from dropping onto the lower chamber through the opening even if water due to dew on the connecting valves or the like drops on the valve mounting plate that supports the connecting valves, whereby the compressor-related electrical parts disposed thereunder are not damaged by the water dropped from the top, (d) the surrounding wall provided on the edge of the opening can compensate the degraded strength of the valve mounting plate due to notching the opening, whereby the pipes can be firmly mounted.

A draining opening is provided at the places on the valve mounting plate other than above the compressor-related electrical parts. Also this draining opening is positioned at the lowest spot lowered gradually from the other spots. These restrictions of positioning the draining opening allow the dropped water, even a little quantity, to flow along gradually lowered spots, and directly drain through the draining opening. Water can be thus drained little by little to a place where the water affect little, therefore, the water less affects the outdoor unit.

DETAILED DESCRIPTION OF EXEMPLARY EMBODIMENTS

The exemplary embodiments of the present invention are described hereinafter with reference to the accompanying drawings.

Figure 1:
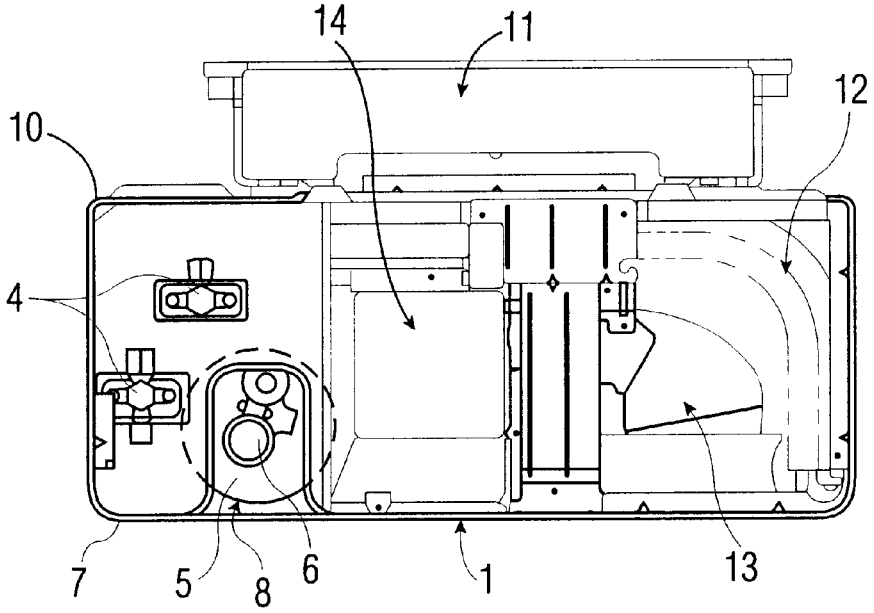
FIG. 1 is a plane view depicting an exemplary embodiment of an outdoor unit of a separate type air-conditioner of the present invention.
Figure 2:
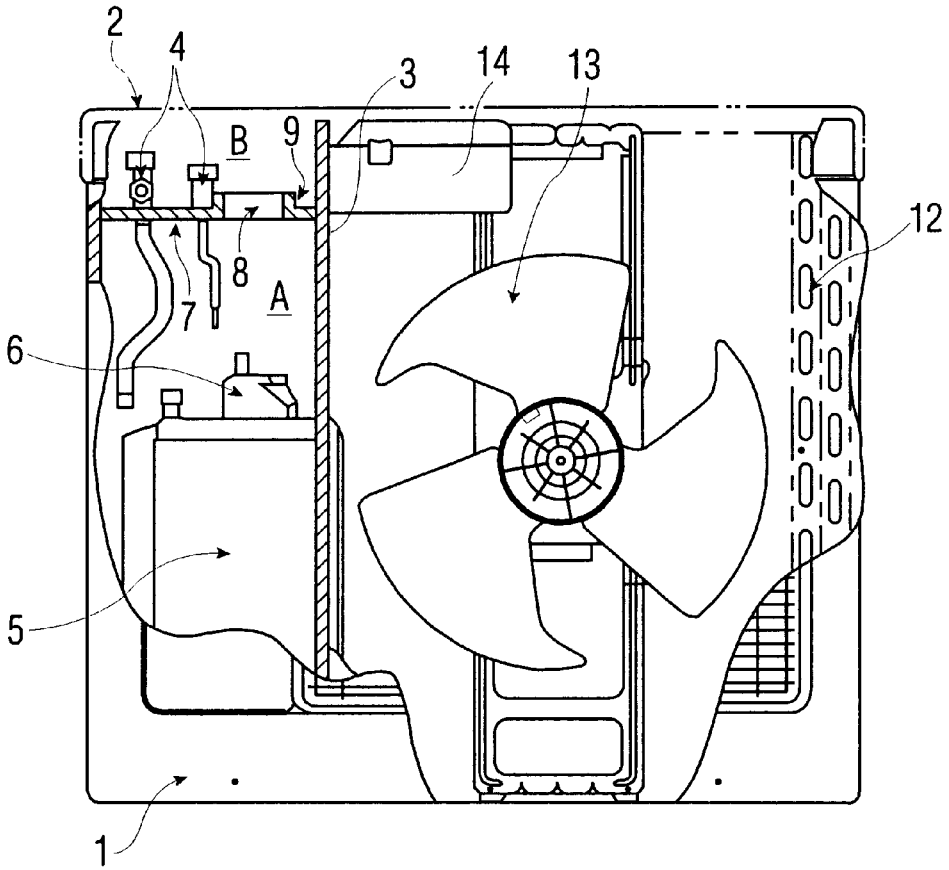
FIG. 2 is a partial cut-away view taken from the front of what shown in FIG. 1.

An outdoor unit for a separate type air-conditioner of the present invention is shown in FIGS. 1 and 2, where the invention is embodied in a box type outdoor unit mounted to an outer wall under a window by a mounting section 11. An upper section of the housing 1 can be disclosed upward by removing a top plate 2.

Inside of the housing 1 is divided by a partition plate 3 into two rooms, i.e. one is a compressor room containing a compressor 5, compressor-related electrical parts 6 and the like, and the other is a fan room containing a heat exchanger 12, a fan 13, a power supply plate 14 and the like.

The compressor room is partitioned by a valve mounting plate 7 into two chambers, namely, a lower chamber A containing the compressor 5 and the compressor-related electrical parts 6, the parts 6 disposed near the compressor 5, and an upper chamber B containing connecting valves that connect the compressor 5 to a coolant pipe from an indoor unit. The connecting valves 4 are fixed to the valve mounting plate 7 with screws or by caulking.

The compressor-related electrical parts 6 comprise an over current relay and a temperature sensor of the compressor. These components must avoid defects and degradation such as a continuity failure due to short-circuit or rust produced by water invasion.

Figure 3:
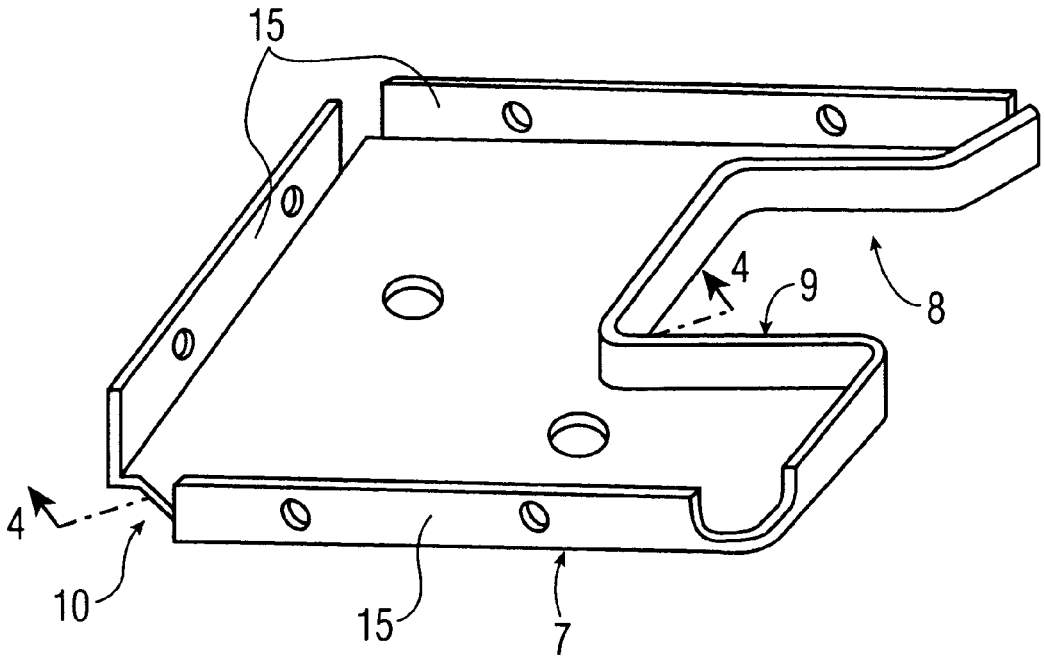
FIG. 3 is an enlarged plane view depicting an exemplary embodiment of a valve mounting plate.
Figure 4:
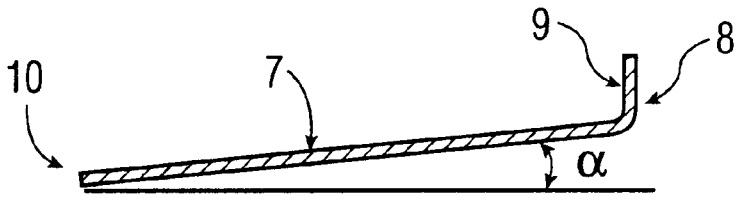
FIG. 4 is a cross sectional view taken on lines 4—4 from FIG. 3.
Figure 5A:
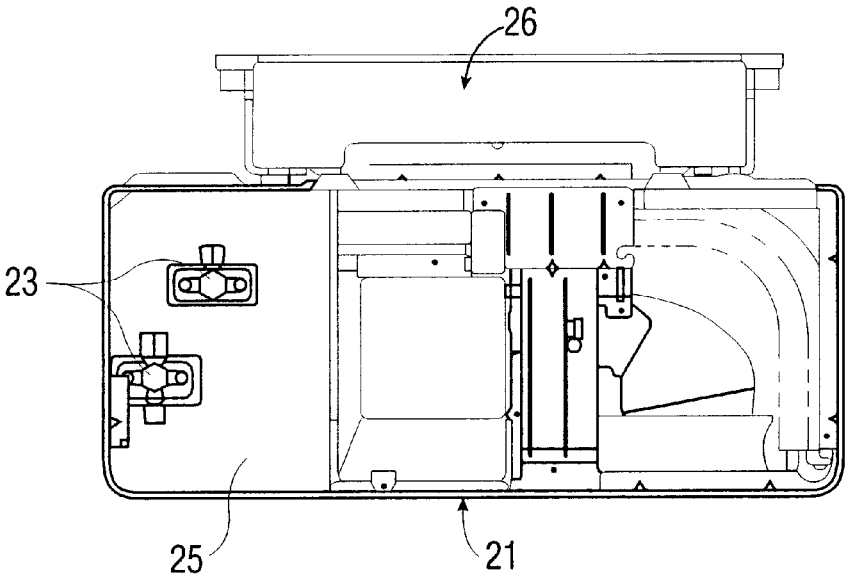
FIG. 5A PRIOR ART
FIG. 5(*a*) is a plane view of a prior art, and FIG. 5(*b*) is a partial cutaway view taken from the front of what shown in FIG. 5(*a*).
Figure 5B:
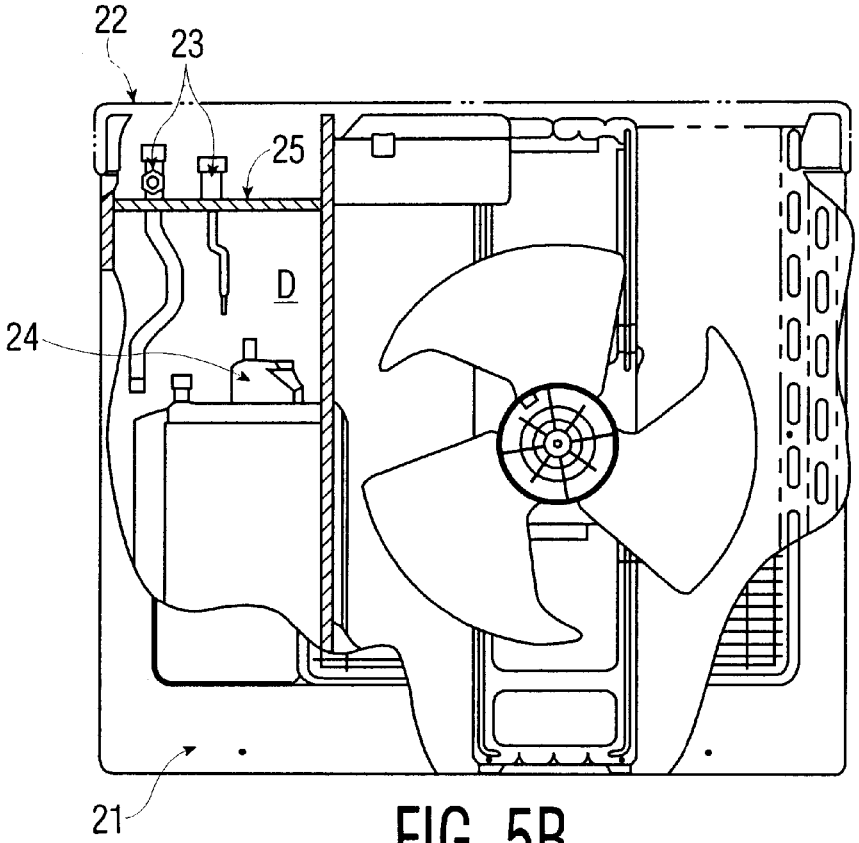
FIG. 5B PRIOR ART

The valve mounting plate 7 is made of metal plate as shown in FIG. 3 and has an opening 8 for work, through which the compressor-related electrical parts 6 can be operated from the top. A surrounding wall 9 rising upward is provided on the edge of the opening 8. A draining opening 10 is provided at a corner. A portion of periphery of the plate 7 is bent upward so that a mounting section 15 for screwing the valve mounting plate 7 to inside of the housing 1 is produced. As shown in FIG. 4, the valve mounting plate 7 is mounted to the housing 1 with a slope of $\alpha$ so that the draining opening 10 at the corner is the lowest lowered gradually from other spots on the plate.

According to this exemplary embodiment, the upper chamber B is disclosed upward by removing the top plate 2, whereby the connecting valves 4 supported by the valve mounting plate 7 disposed there can be connected or disconnected with ease to/from the coolant pipe from the indoor machine. In addition to this, the compressor-related electrical parts 6 can be adjusted or maintained readily when necessary through the opening 8 for work notched on the valve mounting plate 7.

Further, the surrounding wall 9 rising vertically on the edge of the opening 8 for work prevents dew water from dropping onto the lower chamber A through the opening 8 even if water due to dew on the connecting valves 8 or the like drops on the valve mounting plate 7 that supports the connecting valves 4, whereby the compressor-related electrical parts 6 disposed thereunder are not damaged by the water dropped from the top. In addition, the valve mounting plate 7 is mounted with the slope so that the draining opening 10 is the lowest spot because other spots gradually lower toward the opening 10. Water invaded onto the valve mounting plate 7 thus flows toward lower spots sequentially and reaches to the lowest spot, namely, the draining opening 10, through which the water drains by itself immediately. This prevents even a little water from staying on the valve mounting plate 7 thereby rusting the plate 7 and the connecting valve 4.

Still further, the surrounding wall 9 provided on the edge of the opening 8 for work can compensate the degraded strength of the valve mounting plate 7 due to notching the opening, whereby the pipes can be firmly mounted.

In the above embodiment, the opening 8 for work is provided by notching; however, the present invention is not limited to this structure. The location of this opening depends on the placements of the connecting valves 4 and the compressor-related electrical parts 6, and the opening 8 can be notched in a shape of a circle or a square above the parts 6. In this case, the surrounding wall is easily formed by drawing a sheet of metal plate. The surrounding wall can be made of another member and mounted to the edge of the opening 8.

The draining opening 10 is provided at a corner of the valve mounting plate 7 by cutting away a corner; however, the present invention is not limited to this. The lowest spot of the plate 7 is positioned above a place which accepts drain water without any problems, and a hole in a shape of a circle or a square is punched on this lowest spot. Further, a groove can be provided between near the connecting valve 4 and the draining opening 10 with sequential lowering. This groove allows the water on the valve mounting plate 7 gathers and is guided to the draining opening 10 more smoothly.

INDUSTRIAL APPLICABILITY

According to the outdoor unit for the separate type air-conditioner of the present invention, the following advantages are produced; (a) since the upper chamber is disposed upward by removing the top plate, the connecting valves supported by the valve mounting plate can be connected or disconnected with ease to/from the coolant pipe from the indoor unit, (b) the compressor-related electrical parts can be readily adjusted and maintained when necessary, (c) the surrounding wall rising vertically on the edge of the opening prevents dew water from dropping into the lower chamber through the opening even if water due to dew on the connecting valves or the like drops on the valve mounting plate that supports the connecting valves, whereby the compressor-related electrical parts disposed thereunder are not damaged by the water dropped from the top, (d) the surrounding wall provided on the edge of the opening can compensate the degraded strength of the valve mounting plate due to notching the opening, whereby the pipes can be firmly mounted.

A draining opening is provided at the place other than above the compressor-related electrical parts on the valve mounting plate. Also this draining opening is positioned at the lowest spot lowered gradually from the other spots. These restrictions of positioning the draining opening allow the dropped water, even a little quantity, to flow along gradually lowered spots, and directly drain through the draining opening. Water can be thus drained little by little to a place where the water affect little, therefore, the water less affects the outdoor unit. This prevents even a little water on the valve mounting plate from staying for a long time and rusting the valve mounting plate as well as the connecting valves. The present invention thus proves to provide the better outdoor unit for the maintenance.

What is claimed is:

1. An air-conditioner outdoor unit having, a housing with a compressor room that is partitioned by a valve mounting plate into a lower chamber containing a compressor and compressor-related electrical parts and an upper chamber, said valve mounting plate of said air-conditioner outdoor unit comprising:

an opening in the valve mounting plate so that the compressor-related electrical parts can be operated through said opening; and a surrounding wall rising upward and disposed along an edge of said opening.

2. The air-conditioner outdoor unit as defined claim 1, wherein said valve mounting plate has a drain opening at a location other than above the compressor-related electrical parts, and said draining opening located at a lowest position of said valve mounting plate.

* * * * *